US009841189B2

(12) United States Patent
Wartluft

(10) Patent No.: US 9,841,189 B2
(45) Date of Patent: Dec. 12, 2017

(54) LEAN PREMIX BURNER HAVING CENTER GAS NOZZLE

(71) Applicant: Hauck Manufacturing Company, Cleona, PA (US)

(72) Inventor: Bruce Wartluft, Cleona, PA (US)

(73) Assignee: Honeywell International Inc., Morris Plains, NJ (US)

( * ) Notice: Subject to any disclaimer, the term of this patent is extended or adjusted under 35 U.S.C. 154(b) by 848 days.

(21) Appl. No.: 14/169,554

(22) Filed: Jan. 31, 2014

(65) Prior Publication Data

US 2014/0308619 A1 Oct. 16, 2014

Related U.S. Application Data

(60) Provisional application No. 61/758,892, filed on Jan. 31, 2013.

(51) Int. Cl.

| | |
|---|---|
| ***F23D 14/36*** | (2006.01) |
| ***F23C 7/00*** | (2006.01) |
| ***F23D 14/62*** | (2006.01) |

(52) U.S. Cl.

CPC ..... *F23D 14/36* (2013.01); *F23C 7/004* (2013.01); *F23D 14/62* (2013.01)

(58) Field of Classification Search

CPC ..... F23D 14/36; F23D 14/60; F23D 14/64; F23D 14/34; F23C 7/004; F23Q 9/00

USPC ..... 431/2, 9, 183, 284

See application file for complete search history.

(56) References Cited

U.S. PATENT DOCUMENTS

| | | | | |
|---|---|---|---|---|
| 3,273,621 | A * | 9/1966 | Childree | F23D 17/00 431/238 |
| 6,558,153 | B2 * | 5/2003 | Schutz | F23C 6/047 122/235.13 |
| 8,113,821 | B2 | 2/2012 | Feese et al. | |
| 2009/0226852 | A1 * | 9/2009 | Feese | F23C 7/006 431/9 |
| 2013/0122440 | A1 * | 5/2013 | Zink | F23D 14/22 431/354 |

* cited by examiner

*Primary Examiner* — Jorge Pereiro

(74) *Attorney, Agent, or Firm* — Brooks, Cameron & Huebsch, PLLC

(57) ABSTRACT

A lean premix burner has a center fire nozzle, which includes radial gas outlets and a ring of outlets. The gas outlets from the center fire nozzle are fed from a manifold. The center fire gas is controlled separately from the main gas supply, which has several advantages, including enhanced turn down capability.

14 Claims, 10 Drawing Sheets

LEAN PREMIX BURNER HAVING CENTER GAS NOZZLE

CROSS-REFERENCE TO RELATED APPLICATIONS

This claims the benefit of U.S. Provisional Patent Application Ser. No. 61/758,892 filed on Jan. 31, 2013, the disclosure of which is hereby incorporated by reference as if set forth in its entirety herein.

FIELD OF THE INVENTION

This invention relates generally to combustion equipment, and more particularly, it relates to apparatus and methods for lean premix low NOx combustion.

BACKGROUND OF THE INVENTION

Burners may be used in a wide range of well known applications, such as the drying and heating of materials. Stricter regulatory requirements have created a demand for burners that produce low levels of nitrogen oxides (NOx), carbon monoxide (CO) and volatile organic compounds (VOCs). These emissions are a significant source of air pollution, and are thus undesirable.

Several well known techniques for reducing NOx emissions are not well suited for certain burner applications, where, for instance, a compact burner size is required. NOx reduction techniques, such as exhaust gas recirculation or water injection, may not be easy to implement in these applications and may produce undesirable secondary effects, such as reduced thermal and/or combustion efficiency. There is a need for improved burners producing low NOx.

U.S. Pat. No. 8,113,821, entitled "Premix Lean Burner," which is owned by the owner of the present invention and marketed under the name Novastar™ burner, discloses a low NOx burner having oil firing capabilities.

SUMMARY OF THE INVENTION

The inventor has discovered that the Novastar burner described in the 821 patent when placed into service may be subject to process conditions that are sometimes detrimental to smooth operation. For example, when employed in an aggregate drying process that is part of asphalt manufacturing, the burner is sometimes subjected to pressure fluctuations or oscillations because of changes in the process. If the drum into which the burner fires has a momentary high pressure, a flashback may occur. In response to conditions of a flashback, the control system is designed to make an emergency stop on the burner. If the drum has low pressure, the location of the flame may change from the desired position of being attached to or very near the burner to a position that is spaced apart from the burner. Then the flame safety system might no longer see the flame and make an emergency stop. The emergency stop interrupts the process of a significant part of the entire manufacturing facility and is disruptive.

To partially cope with the process conditions and their effects on the flame safety system, the Novastar burner of the 821 patent has been mostly limited to an open-fired configuration, which is defined as including an open area around the annulus or housing of the burner to enable inflow of ambient air around the burner housing into the furnace, combustion chamber. Lean premix burners are prone flame envelope instabilities, and the Novastar burner of the 821 patent required a complicated draft system in an effort to control pressure and combustion-induced oscillations at the burner.

Moreover, industrial burners generally are designed and optimized for a particular firing rate range in BTU per hour. Lean premix burners generally have a turndown ratio (that is, the ratio of the highest to lowest firing rate) that is limited because of their goals of low NOx. But the inventor has found that Novastar 821 burners are often oversized, especially in aggregate drying applications. Operating the Novastar 821 burner at significantly less than its firing rate capacity exacerbates the above problems.

The present invention addresses the above problems, in general, by adding center gas capabilities to the Novastar prior art burner. In this regard, an improved burner assembly for low NOx combustion comprises a combustion air fan inlet; a gaseous fuel inlet; a housing that defines a mixing zone downstream of the combustion air fan inlet and downstream of the gaseous fuel inlet for enabling mixing of fuel and combustion air to form a lean fuel-air mixture; a main nozzle assembly for directing the fuel-air mixture; a gas pilot; and a nozzle-mix, center gas nozzle. The center gas nozzle includes a gas manifold and plural conduits that are oriented radially. The conduits include front-facing gas outlets, whereby gas from the gas manifold exits the conduit gas outlets and combustion air is supplied from the combustion air fan inlet. The gas pilot is configured to initiate combustion of fuel from the center gas nozzle and from the main nozzle. The center gas nozzle can be turned on or off independent of control of the fuel-air mixture. The turndown ratio of this configuration is greater than 10:1.

Preferably, the gas manifold is an annulus that extends to a front of the nozzle, and the conduits (which have individually outlet holes that are axially oriented) extend radially outwardly from the manifold. The center gas nozzles also may include radially-facing outlets near an outlet of the gas pilot. The gas pilot may be located at the center of the nozzle assembly such that an inner wall of the gas manifold forms an outer wall of the gas pilot. The main nozzle may include at least one converging cone, spaced radially apart from the housing, for directing the fuel-air mixture, and at least one flame anchor formed by a bluff surface located proximate a front of the nozzle assembly for anchoring the flame.

Preferably, the burner is a sealed-in burner that includes a swirl vane assembly for mixing the combustion air with the gaseous fuel upstream of the nozzle assembly. The burner may also include a plurality of inner vanes that impart a swirling motion in a first orientation and a plurality of outer vanes that impart a swirling motion in a second orientation wherein said first orientation may be the same as said second orientation. The swirling motion imparted by the inner vanes is opposite in orientation to the swirling motion imparted by the plurality of outer vanes.

The bluff surface preferably is formed proximate a front of the burner assembly and the downstream end is vaneless. Preferably the burner assembly has only gas fuel capacity and contains no oil firing capability. The burner turndown ratio can be between 10:1 and 30:1, more preferably between 14:1 and 28:1, even more preferably between 18:1 and 26:1. Also, the present invention encompasses a turndown ratio is greater than 20:1.

A corresponding method for operating a premix burner for low NOx combustion at high turndown ratios (that is, using the burner described herein) includes the steps of: (a) initiating pilot firing via the gas pilot. After the step of initiating pilot firing, (b) center firing by supplying gas to the main nozzle through a gas manifold and through radial conduits, and operating at a lowermost center firing rate indefinitely. And then (c) operating the burner on the main gaseous fuel, the burner having a capacity for operating during operating step (c) that is at least 10 times the lowermost center firing rate.

The present invention is not limited to structure that addresses all of the drawbacks of the prior art Novastar burner, as the description of the prior art Novastar burner is provided for context. Nor is the invention limited to the particular burner limited to the structure or steps described in this specification. The present invention should be given its scope according to the plain meaning of the claims.

DETAILED DESCRIPTION OF ILLUSTRATIVE EMBODIMENTS

Figure 1:
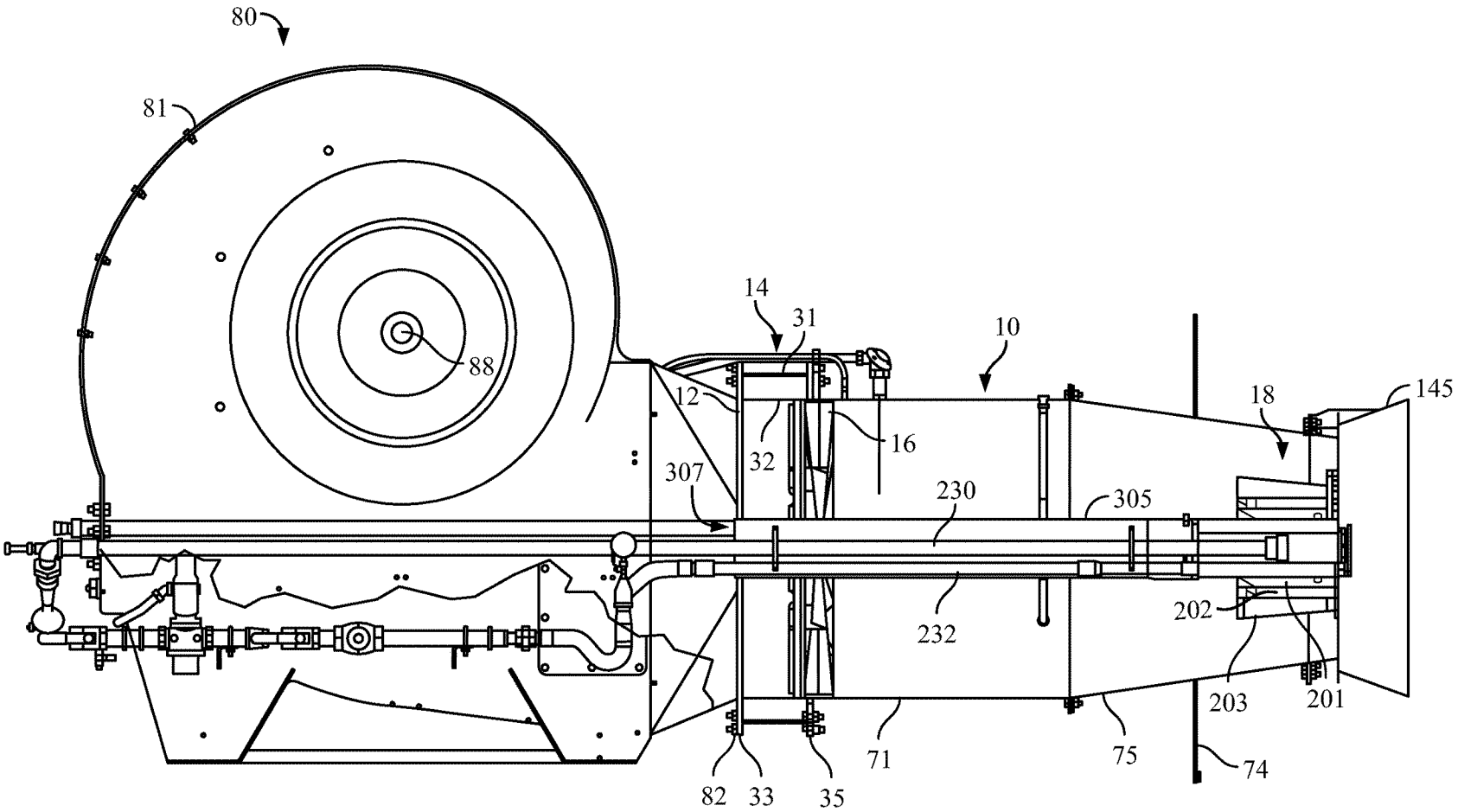
FIG. 1 is a side elevation of an embodiment of a burner assembly, including a center fire nozzle assembly illustrating aspects of the present invention.
Figure 2:
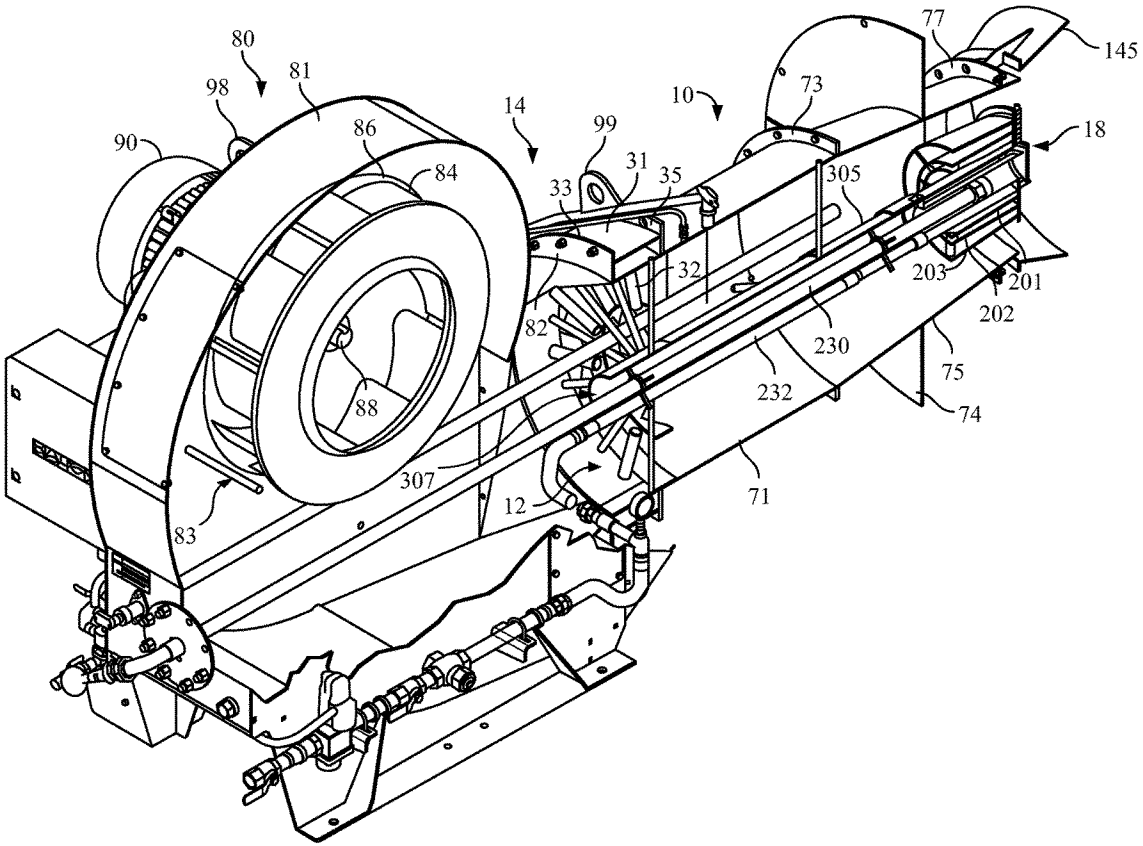
FIG. 2 is a sectional perspective view of the burner assembly and combustion air fan of FIG. 1.

FIGS. 1 and 2 depict an embodiment of a premix lean burner assembly for low NOx combustion having improved capabilities. As shown, a burner assembly 10 includes a combustion air fan inlet 12, a gaseous fuel inlet manifold assembly 14, a counter-swirl vane assembly 16, and a center gas nozzle assembly 18. Nozzle 18 is changed from the Novastar burner of the 821 patent.

Consistent with the burner of the 821 patent, combustion air fan inlet 12 may include a first flange 33 that may be integral with the gaseous fuel inlet manifold assembly 14 (as more fully described below) for attaching to a combustion air fan 80. Combustion air fan 80 preferably is a conventional centrifugal fan having a tangential outlet. Combustion air fan 80 includes a fan housing 81, a mating flange 82 and a fan wheel 83 having a plurality of blades 84 and a fan hub 86 for mounting the plurality of blades 84. FIG. 2 also shows a fan motor 90 and a fan driveshaft 88 for turning the fan hub 86. The present invention is not limited to the structure of combustion air fan 80, but rather encompasses employing any fan type or structure, and encompasses any source of air provided to the burner assembly such that no fan is required unless specifically stated in the claim.

The gaseous fuel inlet manifold assembly 14 has a second flange 35 for attaching to a burner housing. The burner housing preferably includes cylindrical housing section 71 and a frusto-conical housing section or converging housing cone 75, as best shown in the embodiment depicted in FIG. 2. The housing portions of the manifold assembly may also be considered a portion of the burner assembly housing depending on the context, as will be clear to persons familiar with burner technology.

Figure 3:
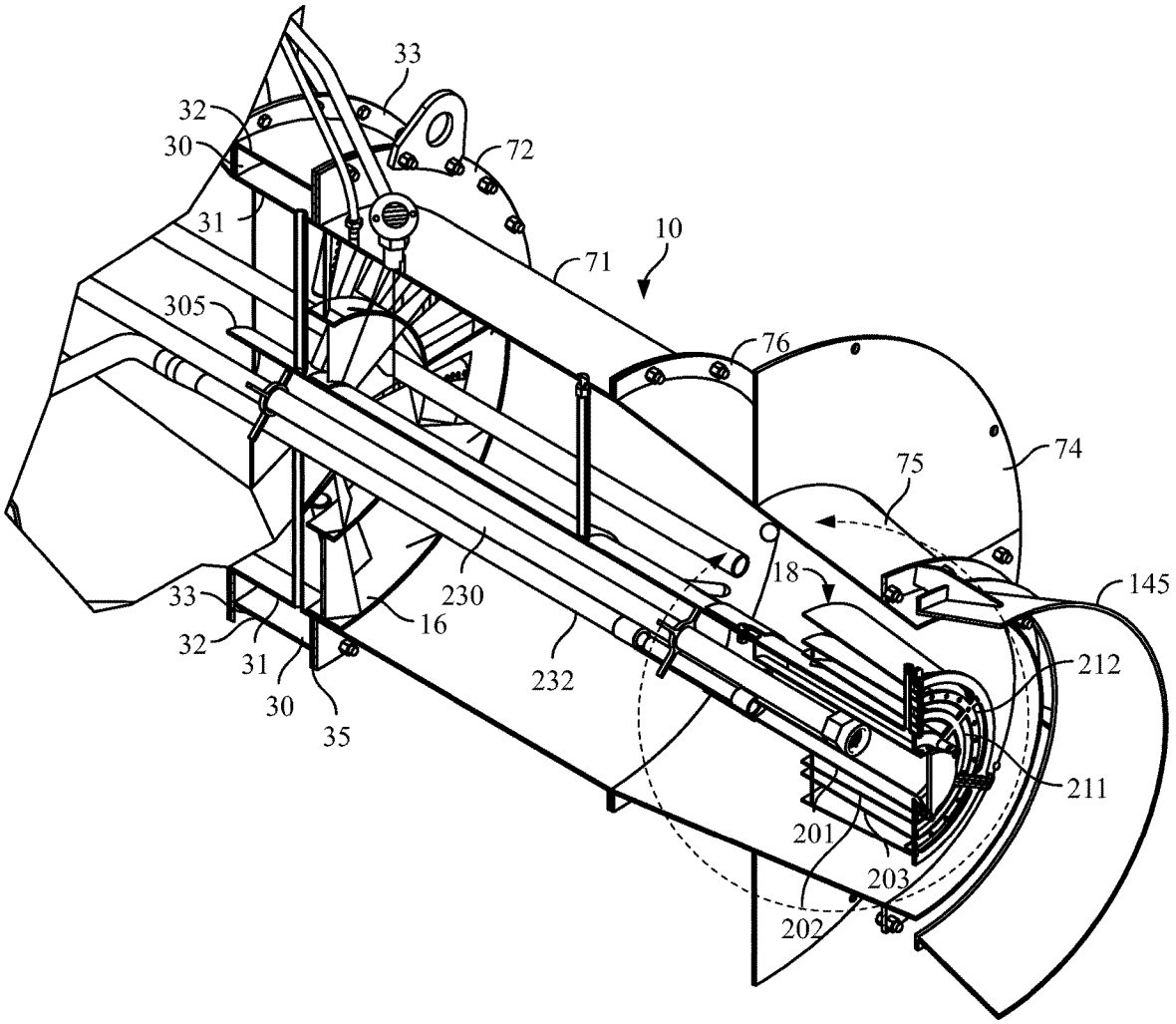
FIG. 3 is an enlarged sectional perspective view of the burner assembly of FIG. 1.

FIG. 3 shows an enlarged sectional perspective view of the burner assembly 10. Gaseous fuel inlet manifold assembly 14 includes a gaseous fuel chamber 30, which is partially defined by flanges 33 and 35, both of which are attached to an inner cylindrical shell 31 and an outer cylindrical shell 32. The inner cylindrical shell 31 is concentric with the outer cylindrical shell 32 to form a plenum for distributing gas fuel.

Referring to FIGS. 2 and 3, the cylindrical housing section 71 includes a first housing flange 72 for attaching to the gaseous fuel inlet manifold assembly 14 and a second housing flange 73 for attaching to the frusto-conical housing section 75. Frusto-conical housing section 75 includes an upstream flange 76 for attaching to the cylindrical housing section 71 and a downstream flange 77 for attaching to a diverging cone 145 proximate the downstream end of the burner assembly 10. As shown in FIG. 2, lifting eyes 98 and 99 may be attached to the combustion air fan 80 and the burner assembly 10 for easy lifting an relocation of the fully assembled unit shown in FIG. 2.

Figure 4:
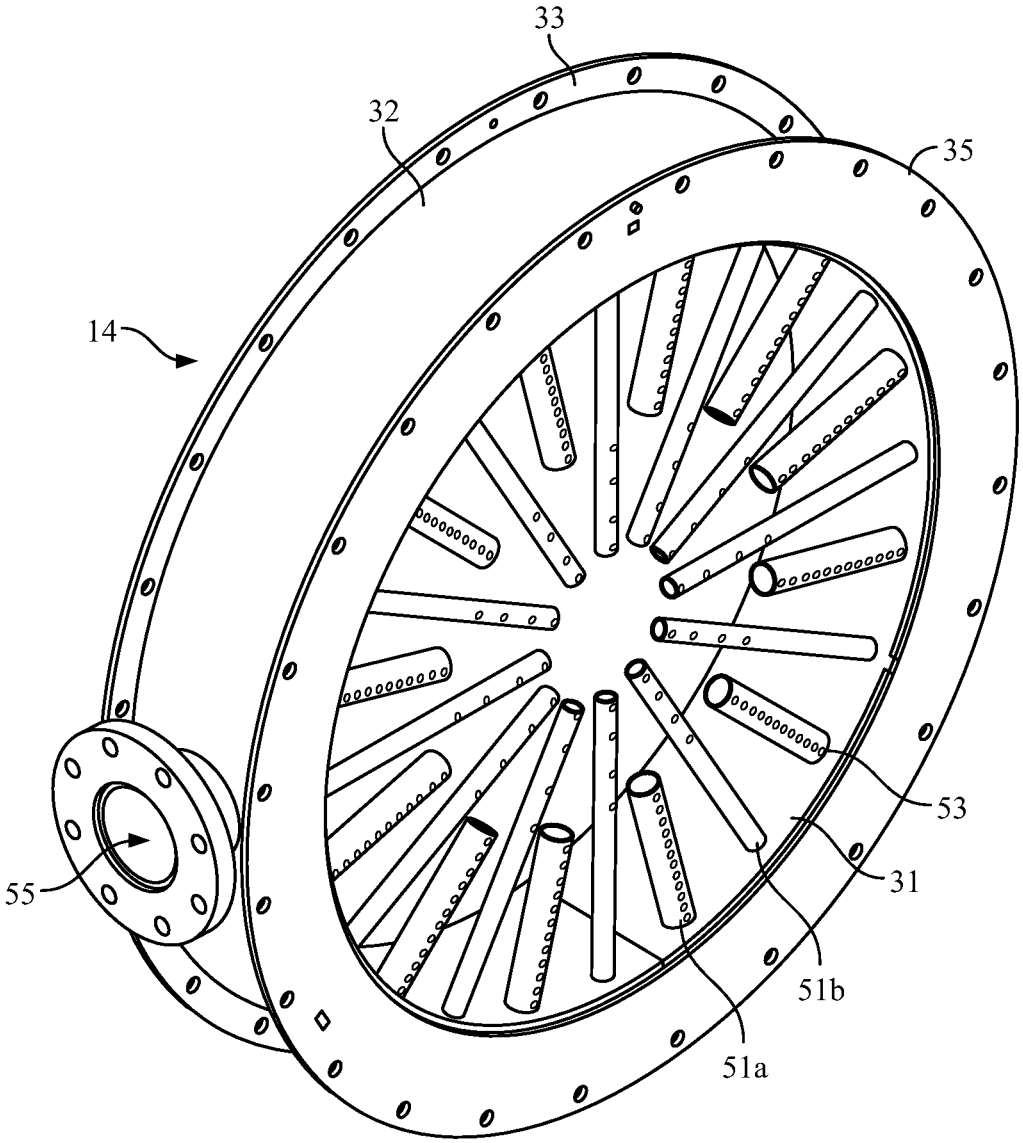
FIG. 4 is an enlarged perspective view of the gaseous fuel inlet manifold assembly shown in FIG. 3.
Figure 5:
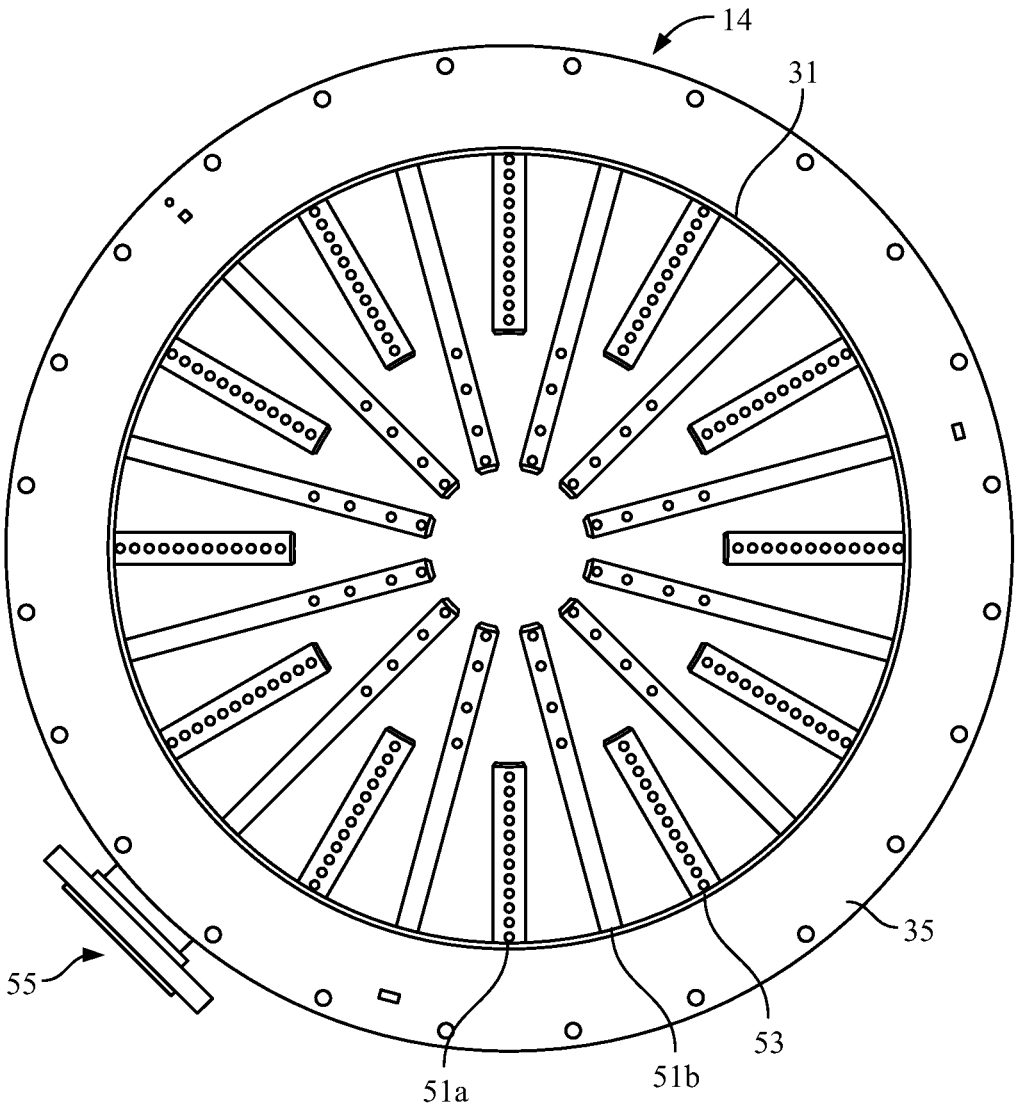
FIG. 5 is an end view of the gaseous inlet manifold assembly of FIG. 4.
Figure 6:
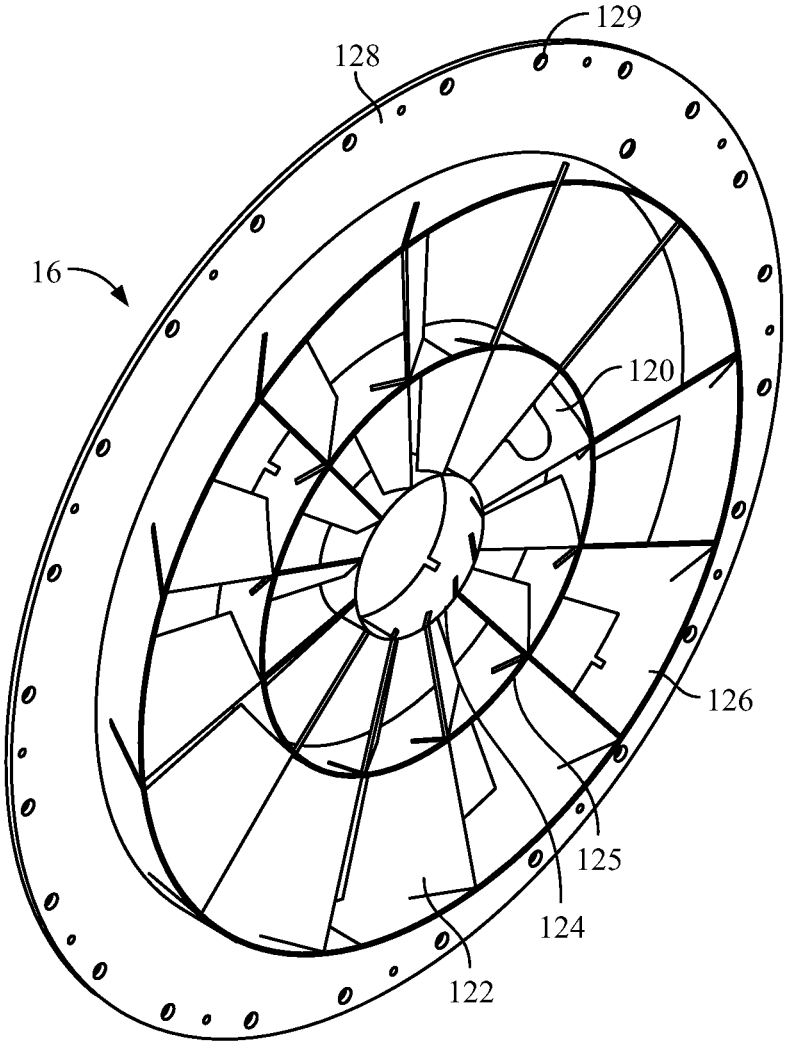
FIG. 6 is an enlarged perspective view of the counter-swirl vane assembly shown in FIG. 3.

FIG. 4 depicts a perspective view of gaseous fuel inlet manifold assembly 14. Gaseous fuel inlet manifold assembly 14 includes a main fuel inlet 55 and a plurality of tubes 51, each tube having a multiplicity of perforations or ports 53. The tubes 51 may be cylindrical in shape and may generally extend radially inward from the gaseous fuel chamber 30 (shown in FIG. 3) toward the center of the circumference formed by the inner cylindrical shell 31. As seen in FIG. 4, tubes 51 vary length and diameter. As an example, the gaseous fuel inlet manifold shown in FIG. 4 is configured with alternating short tubes 51*a* and long tubes 51*b*, with the short tubes 51*a* extending distally a fraction of the distance that the long tubes 51*b* extend. The exemplary long-short tube configuration just described may also be seen in FIG. 5, which shows an end view depiction of the gaseous fuel inlet manifold assembly 14. FIG. 6 illustrates counter-swirl vane assembly 16.

Figure 7:
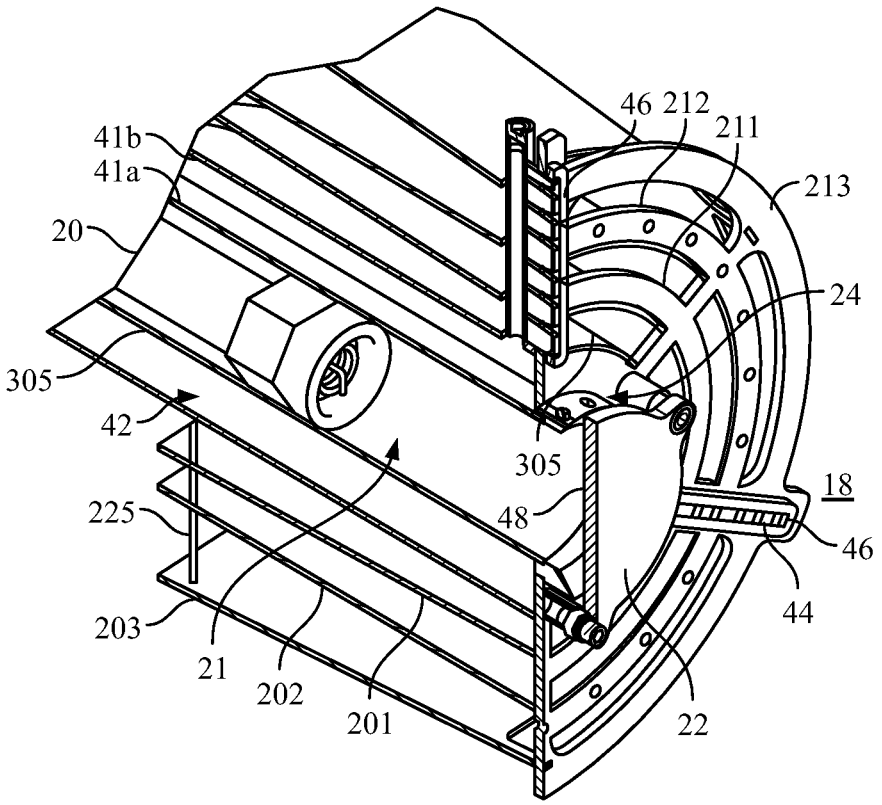
FIG. 7 is an enlarged perspective view of the nozzle assembly shown in FIG. 1.
Figure 8:
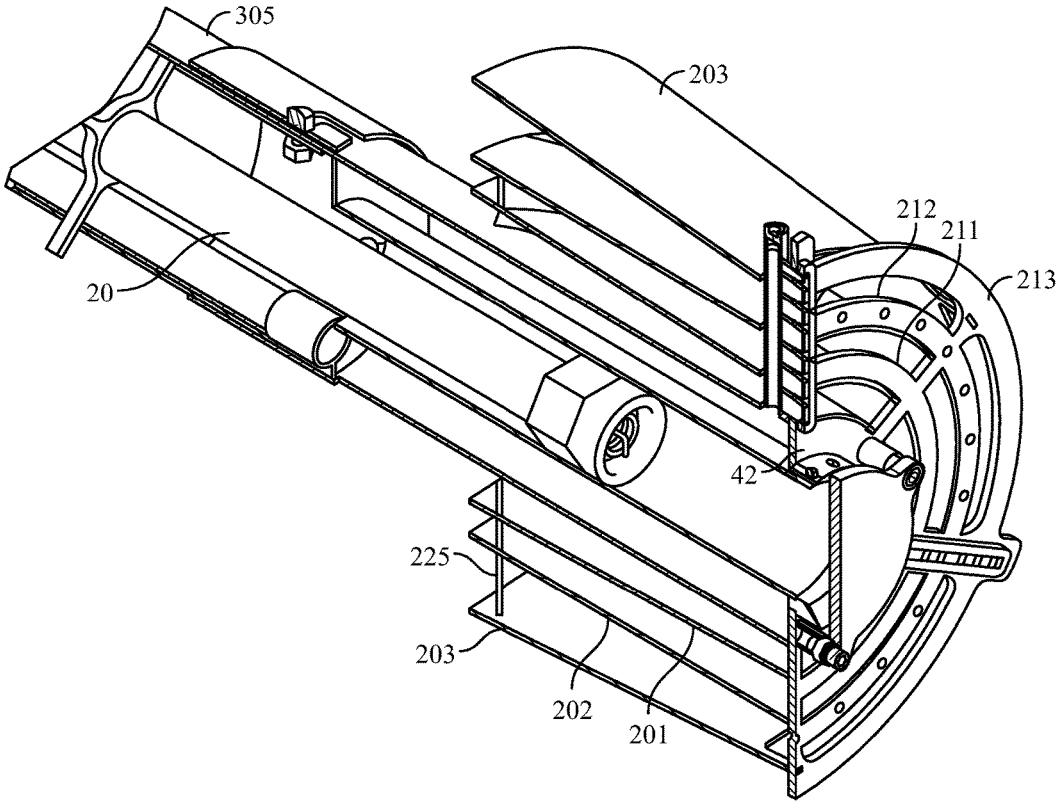
FIG. 8 is an another enlarged end view of nozzle assembly portion of FIG. 1.
Figure 9:
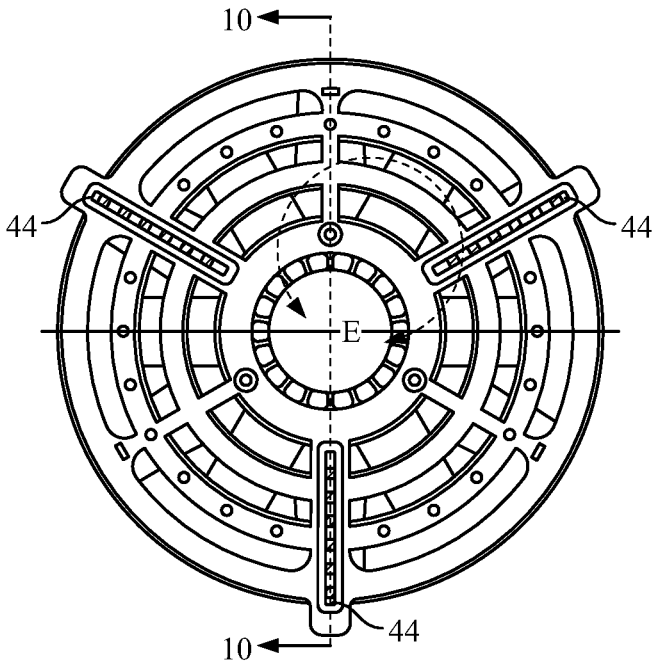
FIG. 9 is end view of the nozzle assembly of FIG. 7.
Figure 10:
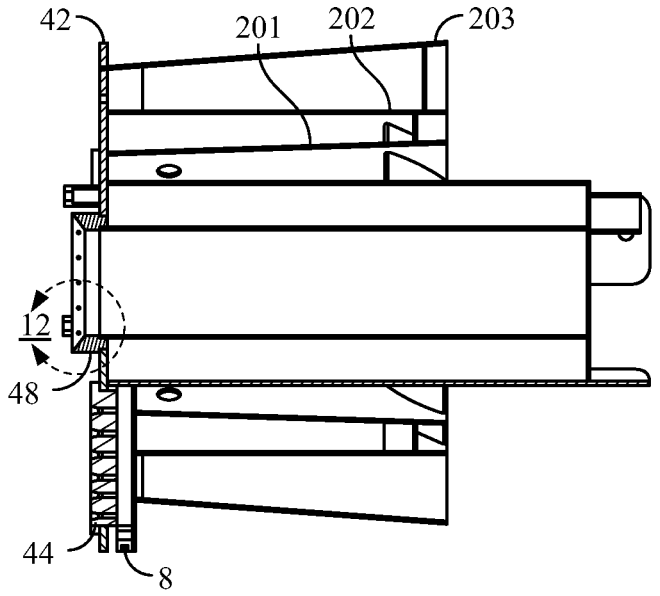
FIG. 10 is a cross sectional view of the nozzle assembly of FIG. 7
Figure 11:
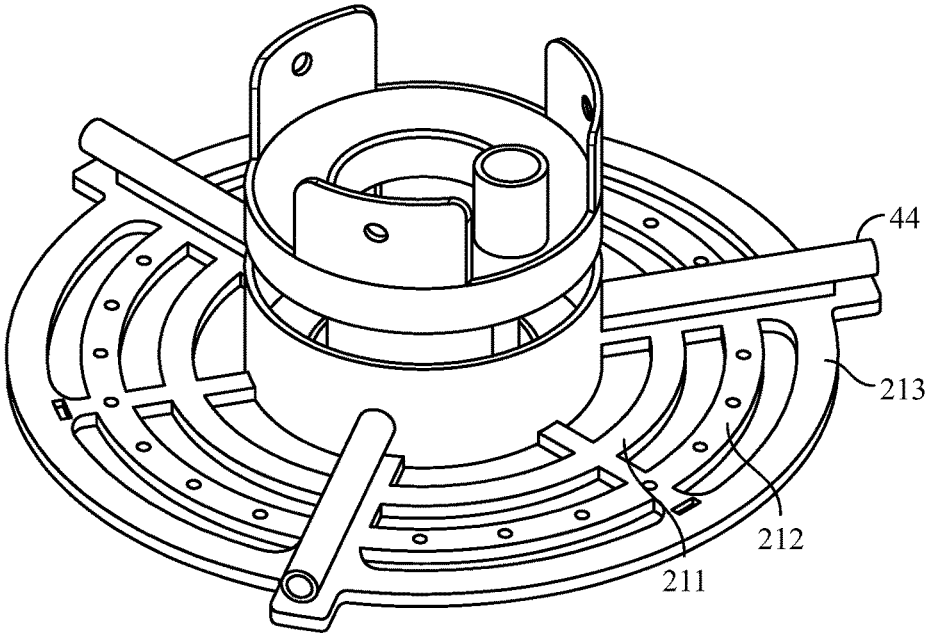
FIG. 11 is an enlarged perspective view of a rear portion of the nozzle assembly of FIG. 7 with parts removed for clarity.

FIGS. 7 and 8 depict an enlarged view of an embodiment of the nozzle assembly 18. Nozzle assembly 18 includes outer shells, center fire gas capabilities, and a pilot burner. Nozzle 18 includes a first shell 201, a second shell 202, and a third shell 203. The first shell 201 preferably is concentric with the second shell 202, and preferably includes a bluff structure having a first bluff surface 211. The second cylindrical shell 202 has a diameter greater than that of the first cylindrical shell 201 and preferably includes a bluff structure having a second bluff surface 212. Outer shell 203 has a diameter greater than second shell 202 and preferably includes a bluff structure having a third bluff surface 213. Outer shell 203 preferably is frusto-conical.

Bluff surfaces 211, 212, and 213 may be integral with cylindrical shells 201, 202, and 203, respectively, or may each be attached to corresponding structure 201, 202, and 203 as separate pieces. Furthermore, bluff surfaces 211, 212, and 213 may generally be located toward the front, or downstream end, of the nozzle assembly 18. Shells 201, 202, and 203 may be cylindrical or conical or other shaped. As FIG. 7 shows, shells 201, 202, and 203 may generally extend longitudinally downstream the same distance as each other to the downstream end of the burner assembly such that the downstream end faces of the shells are parallel and lie in the same plane that is perpendicular to the long axis of the burner. The present invention is not limited to the structure of the shells or bluff bodies particularly disclosed herein.

As best shown in FIGS. 7 and 8, and overall in FIGS. 1 through 3, burner assembly 10 includes a center gas pilot assembly 20. Gas pilot 20 is supplied with gas by a pilot gas tube 230, which extends from the rear of the burner. Gas pilot 20 is located in a center air tube 305 that has an inlet 307 that receives pilot combustion air from fan 80.

Nozzle 18 includes a gas manifold 42 that preferably is an annulus between inner manifold wall 41*a* and outer manifold wall 41*b*. Manifold walls 41*a* and 41*b* are concentric with the burner longitudinal center line and with gas pilot assembly 20. Manifold inner wall 41*a* can be coextensive with a portion of center air tube 305. Inner manifold wall 41*a* thus forms a housing for gas pilot 20. A gas diffuser plate 22 is located at the outlet end of inner manifold wall 41*a* to form a plenum 21 that stabilizes the pilot flame. Diffuser plate 22 is spaced apart from an end of inner manifold wall 41*a* to provide outlets or holes 24 for the pilot flame. Holes 24 are located about diffuser plate 22 to provide a ring of pilot flame outlets.

The fuel for the center fire capabilities of nozzle 18 is provided through manifold 42, which is fed from a center fire gas supply tube 232. Center fire gas supply tube 232 has valves and controls that are independent from the pilot gas supply to enable the pilot and center fire capabilities to be controlled independently from one another. Radial gas outlet conduits 44 extend from the forwardmost end of manifold 42. Fuel exiting manifold 42 flows radially outwardly through radial conduits 44 and through holes 46 spaced along conduits 44. The holes 46 are each (preferably axial oriented) and arranged along conduits 44, which are radially oriented. Radial outlet conduits 44 preferably are radial tubes that extend outwardly from manifold 42 such that the gaseous fuel exiting conduits 44 extends across the entire radius of nozzle 18, such as across the three shells 201, 202, and 203. An outermost tip of radial outlet conduits are attached to outermost bluff body 213. The figures show three radial conduits 44, and the present invention encompasses other configurations and quantities of outlets.

Figure 12:
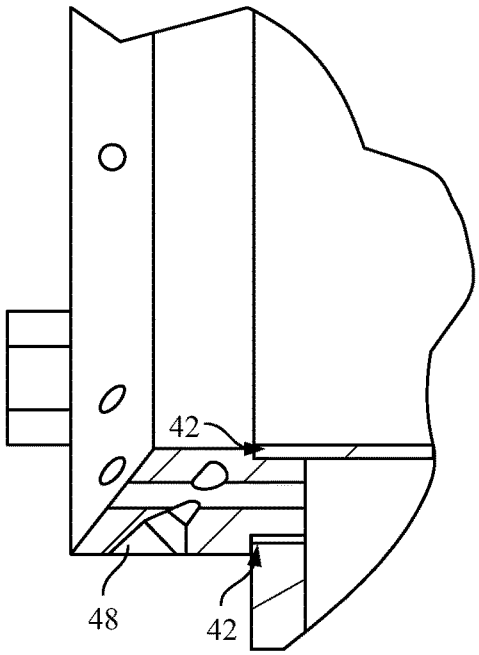
FIG. 12 is an enlarge view of a portion of FIG. 10 identified by reference numeral 12.

Manifold 42 also has a ring of outlet holes 48 located at or near the forwardmost end of manifold 42 such that holes 48 are located about the periphery diffuser plate 22. As best shown in FIG. 12, holes 48 are formed at or near the front end of manifold 42 and have an outlet that is oriented radially outward at an oblique angle.

The description of the function and operation of the burner assembly 10 is provided below according to an aspect of the present invention.

Referring now to FIG. 2, power is supplied to fan motor 90 of combustion air fan 80 to provide combustion air to the burner assembly 10. Motor 90 driving fan blades 84 via shaft 88 provides combustion air to burner assembly 10.

As shown in FIGS. 2-4, mating flange 82 of the combustion air fan 80 is bolted to the first flange 33 of gaseous fuel inlet manifold assembly 14 such that combustion air discharged from combustion air fan 80 enters the burner assembly 10 through the combustion air fan inlet 12. Upon passing through the combustion air fan inlet 12, the combustion air discharge flows through the gaseous fuel inlet manifold assembly 14 around the plurality of tubes 51. Gaseous fuel is introduced from an external source (not shown) into the main gaseous fuel inlet 55 of the gaseous fuel inlet manifold assembly 14 such that the gaseous fuel chamber 30 is filled with gaseous fuel and said gaseous fuel flows into the plurality of tubes 51*a* and 51*b* and exits through the multiplicity of ports 53 into the combustion air stream. Ports 53 preferably are generally directed in the downstream direction of the burner assembly 10, and other configurations are contemplated. The combustion air stream flows around the plurality of tubes 51 of the gaseous fuel inlet manifold assembly 14 such that the combustion air entrains gaseous fuel flowing out of the multiplicity of port 53 in tubes 51*a* and 51*b* of the gaseous fuel inlet manifold assembly 14.

As can be observed in FIGS. 2, 3 and 6, upon passing through gaseous fuel inlet manifold assembly 14, the combustion air discharge and gaseous fuel flows through counter-swirl vane assembly 16 which is attached to the gaseous fuel inlet manifold assembly 14 by, for example, fastening with bolts (through holes 129) the flange 128 of the counter-swirl vane assembly to the second flange 35 of the gaseous fuel inlet manifold assembly 14. The fuel-laden combustion air flow, downstream of the gaseous fuel inlet manifold assembly 14, subsequently flows through the counter-swirl vane assembly 16, where a first portion of the fuel-laden air flows through the plurality of inner vanes 120 and a second portion of the fuel-laden air flows through the plurality of outer vanes 122. By passing through the plurality of inner vanes 120, the first portion of fuel-laden air may be imparted a swirl motion in a first orientation, for example clockwise. By passing through the plurality of outer vanes 122, the second portion of fuel-laden air may be imparted a swirl motion in a second orientation, for example, counter-clockwise, which is opposite to the first swirl orientation imparted by the plurality of inner vanes 120. The simultaneous opposite swirling motions imparted by the plurality of inner vanes 120 and the plurality of outer vanes 122 results in enhanced mixing of the gaseous fuel and the combustion air to form a fuel-air mixture in the burner assembly 10. Rings 124, 125, and 126 provide structure to the vanes.

Referring now to FIGS. 2 and 3, once the fuel-air mixture exits the counter-swirl vane assembly 16, it enters the cylindrical housing section 71 which may be attached to the counter-swirl vane assembly 16 by bolting, for example, the first housing flange 72 of the cylindrical housing section 71 to the flange 128 of the counter-swirl vane assembly 16. After allowing the enhanced fuel-air mixing to develop in cylindrical housing section 71, the air-fuel flow may be accelerated in the frusto-conical housing section 75 of the burner assembly 10. Frusto-conical housing section 75 may be attached to the cylindrical housing section 71 of the burner assembly 10 by fastening with bolts, for example, the upstream flange 76 of the frusto-conical housing section 75 to the second housing flange 73 of the cylindrical housing section 71.

The combustion air fan 80 may be controlled, for example, by a variable frequency drive (VFD), a damper mechanism or some other suitable mechanism which a person familiar with this technology would know how to select. The combustion air fan 80 may provide a flow of combustion air in excess of the stoichiometric amount required to burn the gaseous fuel supplied through the gaseous fuel inlet manifold assembly 14. Precise control of the resulting air-to-fuel ratio (A/F) of the fuel-air mixture and the enhanced gaseous fuel mixing achieved with counter-swirl vane assembly 16 may help minimize peak flame temperatures produced by burner assembly 10. The burner preferably operates at 40 percent excess air, more preferably at approximately 50 percent excess air, which provides an adiabatic flame temperate of a maximum of 2800 degrees F., which is generally considered a threshold for thermal NOx formation.

A first portion of the accelerated air-fuel mixture in frusto-conical housing section 75 may enter the nozzle assembly 18 and may flow into the first cylindrical shell 201, the second cylindrical shell 202 and the converging nozzle cone 203. A second portion of the air-fuel mixture in frusto-conical housing section 75 may flow around converging nozzle cone 203 through the annular volume formed between the converging nozzle cone 203 and the frusto-conical housing section 75. Converging nozzle cone 203 aids in directing the first portion of flow toward the annular volume formed between the center air tube 305 and the first cylindrical shell 201. Converging cone 203 also aids in directing said first portion of flow through the annular volume formed between the first cylindrical shell 201 and the second cylindrical shell 202.

The pilot flame exits nozzle 18 from holes around diffuser plate 22, as explained above. Main, premixed gas and air from fuel inlet manifold 14 and combustion air fan 80 and may be ignited by the pilot flame. Center fire flame from holes 46 and 48 may anchor and stabilize the flame from the premixed gas and air. The flame may be anchored to the nozzle assembly 18 by the first bluff body surface 211 of cylindrical shell 201, the second bluff body surface 212 of second cylindrical shell 202, and the third bluff body surface 213 of cone 203. Furthermore, acceleration of the air-fuel mixture by the frusto-conical housing section 75 and the converging nozzle cone 203 may assist in preventing flash-back of the flame into the burner assembly 10. The flame formed at the front of the nozzle assembly 18 is allowed to develop with the aid of the diverging cone 145, which may assist in anchoring and stabilizing said flame by, for example, inhibiting entrainment and blowoff. Furthermore, as shown in FIG. 8, nozzle assembly 18 optionally includes a plurality of spin vanes 225 located proximate the inlet portion of nozzle 18, for stabilizing the burner flame.

Center fire air fuel may exit from holes 46 and from inner ring holes 48, as supplied from center fuel manifold 42. This center firing capability added to the prior art Novastar burner adds self-piloting functionality. Because burner 10 preferably is fitted with separate controls for center file fuel (through manifold 42) and main fuel (through main fuel assembly 14), center fire gas can be controlled or turned off to achieve high turndown ratios.

Sealed-in versions of the burner shown in FIG. 1 have achieved approximately 30% reduction in CO ppm. The term "sealed-in" refers to enclosing an opening into which the burner system 10 is installed, such as by bolting flange 74 (FIGS. 1 through 3) onto a wall of a furnace or combustion chamber or housing wall. In this regard, "sealed-in" is not "open-fired."

The configuration of the burner described herein, including the ability to seal-in the burner, the center firing, and the self-piloting provides several advantages, including increasing overall efficiency and emissions reductions; improved ignition, reliability, and low-fire stability improved operating window and turndown, which improve the ability of burner 10 to be adapted to system requirements; ability to adjust and extend low-fire runtime, such as during preheating, and simplification of burner and draft control system scheme. Self-piloting refers to the common flame base for the flame from the center fire gas and the main flame gas.

Sealing in burner 10 enhances fuel efficiency by not wasting heat with higher excess air, which also improves heat transfer to the aggregate or other product. The center fire system improves burner ignition of main gas.

The center fuel firing enables the burner described herein to operate at a turndown ratio of 10:1 or greater. The inventors have demonstrated that turndown ratios of 30:1 can be achieved. Preferably, the turndown ratio is between 14:1 and 28:1, preferably between 18:1 and 26:1; preferably greater than 20:1.

The high turndown ratio with good combustion characteristics of the present burner enables an improved combustion operating window for better system adaptability and control over many individual plant variables that must work in unison, such as total system operation and operation of various plant components along. The predictability of operation of burner 10 also enables more reliable sizing and layout of the system and its components. There are also benefits to production rates (tph) and operating conditions, for example ambient conditions various, mix designs (such as aggregate particle size and their percentages in total mix), and moisture percentages of aggregate.

The burner of the present invention has advantages during the process of starting up the aggregate of other process in which the burner system 10 is installed. For example, the center fire nozzle has the ability to operate alone at "low-fire." This low-fire capacity enables the burner to be adjusted to each individual plant to achieve indefinite run time for preheat of system components (such as a baghouse, ductwork, and the like) to achieve system temperature above dew point. Dew point for the process combustion gases typically are approximately 250-290 degrees F. High firing will provide gases above the dew point, but may reach unacceptable temperatures, such as a high stack temperature limit. In this way, the center firing capabilities of burner 10 can eliminate commonplace procedure of numerous cycles of burner starts and restarts due to reaching high stack temperature safety limit, in many circumstances.

Further, the improvements to burner 10 enable a simplified burner and draft control scheme. The self-piloting effect of the center fire burner improves ignition and low fire stability, and it enables eliminating complex control schemes. For example, in the prior art burner, an ignition and transition to low fire required careful control and adjustment of individual burner and draft throughout the transition.

The present invention is not limited to the particular structures and advantages disclosed herein, but rather encompasses variants as will be clear to persons familiar with burner technology and encompasses all structures recited and following from the language of the claims. For example, the present invention is not limited to a burner having, nor limited to the particular structure recited for, the counter-swirl vane assembly, fuel manifold, converging nozzle cone, and like components, unless the structure is stated in the claim. The embodiments described are illustrative, and the present invention is not limited to said embodiments.

The invention claimed is:

1. An improved burner assembly for low NOx combustion, comprising:

a combustion air fan inlet;

a gaseous fuel inlet;

a housing that defines a mixing zone downstream of the combustion air fan inlet and downstream of the gaseous fuel inlet for enabling mixing of fuel and combustion air to form a fuel-air mixture;

a main nozzle assembly for directing the fuel-air mixture;

a gas pilot; and a nozzle-mix, center gas nozzle including:

a gas manifold having a plurality of outlets oriented radially outward;

plural conduits that are oriented radially, the conduits including front-facing gas outlets, whereby gas from the gas manifold exits the front-facing gas outlets and combustion air is supplied from the combustion air fan inlet;

whereby the gas pilot is configured to initiate combustion of fuel from the nozzle-mix, center gas nozzle and from the main nozzle assembly, whereby the nozzle-mix, center gas nozzle can be ignited or extinguished independent of control of the fuel-air mixture, and whereby a turndown ratio of the burner assembly is greater than 10:1.

2. The burner assembly of claim 1 wherein the gas manifold is an annulus that extends to a front of the nozzle-mix, center gas nozzle, and the conduits extend radially outwardly from the manifold.

3. The burner assembly of claim 1 wherein the plurality of outlets of the gas manifold are located near an outlet of the gas pilot.

4. The burner assembly of claim 1 wherein the gas pilot is located at the center of the main nozzle assembly such that an inner wall of the gas manifold forms a housing for the gas pilot.

5. The burner assembly of claim 1 wherein the main nozzle assembly includes at least one converging cone, spaced radially apart from the housing, for directing the fuel-air mixture, and at least one flame anchor formed by a bluff surface located proximate a front of the nozzle assembly for anchoring the flame.

6. The burner assembly according to claim 5, wherein the bluff surface is formed proximate a front of the burner assembly and a downstream end is vaneless.

7. The burner assembly of claim 1 wherein the burner is a sealed-in burner.

8. The burner assembly according to claim 1 further comprising a swirl vane assembly for mixing the combustion air with the gaseous fuel upstream of the main nozzle assembly.

9. The burner assembly according to claim 8 wherein a swirling motion imparted by a plurality of inner vanes of the swirl vane assembly is opposite in orientation to a swirling motion imparted by a plurality of outer vanes of the swirl vane assembly.

10. The burner assembly according to claim 1 wherein the burner assembly contains no oil firing capability.

11. The burner assembly according to claim 1 wherein the turndown ratio is between 10:1 and 30:1.

12. The burner assembly according to claim 1 wherein the turndown ratio is between 14:1 and 28:1.

13. The burner assembly according to claim 1 wherein the turndown ratio is between 18:1 and 26:1.

14. The burner assembly according to claim 1 wherein the turndown ratio is greater than 20:1.

* * * * *